United States Patent [19]

Sugioka et al.

[11] Patent Number: 4,602,787

[45] Date of Patent: Jul. 29, 1986

[54] HOLLOW METAL GOLF CLUB HEAD

[75] Inventors: Yasuhiro Sugioka; Hiroshi Kobayashi, both of Fuchu, Japan

[73] Assignee: Ryobi Limited, Tokyo, Japan

[21] Appl. No.: 688,321

[22] Filed: Jan. 2, 1985

[30] Foreign Application Priority Data

Jan. 11, 1984 [JP] Japan ..... 59-2624[U]

[51] Int. Cl.[4] ..... A63B 53/04

[52] U.S. Cl. ..... 273/171; 273/172; 273/167 H

[58] Field of Search ..... 273/167 H, 169, 171, 273/172, 173, 174, 167 F, 167 A, 168

[56] References Cited

U.S. PATENT DOCUMENTS 1,582,836 4/1926 Link ..... 273/167 H 3,567,228 3/1971 Lynn ..... 273/169

4,214,754 7/1980 Zebelean ..... 273/167 H

*Primary Examiner*—George J. Marlo

*Attorney, Agent, or Firm*—Frishauf, Holtz, Goodman & Woodward

[57] ABSTRACT

The sole plate of a hollow metal golf club head includes a pair of V-shaped reinforcing ribs having their spaced apart ends engaging the rear surface of the striking face. The inner ends of the V-shaped ribs engage the front side of a protrusion on the sole plate, and the rear side of the protrusion engages a hollow weight chamber. Another reinforcing rib connects the weight chamber to the rear wall of the club head. A threaded bolt passes through an aperture in the protrusion on the sole plate, and is threaded into the upper portion of the club head, thereby fastening the sole plate thereto.

6 Claims, 4 Drawing Figures

HOLLOW METAL GOLF CLUB HEAD

BACKGROUND OF THE INVENTION

This invention relates to a golf club head, and more particularly a golf club head made of such metal as steel and having the same size and configuration as that made of wood.

A hollow metal head has been known. However, such metal head has been shaped to be smaller than that made of wood for the purpose of making it have comparative weight. Such light weight head, however, does not have the same size and configuration as that made of wood. A hollow, thin-wall metal head filled with plastic has been proposed.

In such thin wall metal head, even though it is filled with plastic the face portion of the head is deformed due to repeated shocks caused by impact against golf balls, with the result that the distance and direction of flight of the golf balls would be greatly influenced.

SUMMARY OF THE INVENTION

It is an object of this invention to provide an improved golf club head having a light weight but having a sufficient strength and which can be made to have substantially the same size and configuration as a head made of wood.

Another object of this invention is to provide a novel golf club made of metal having a low center of gravity and which can propel a golf ball over a long distrance and in a desired direction.

According to this invention there is provided a golf club head comprising a thin-wall, hollow main body made of metal and provided with a bottom opening, a sole plate made of metal and secured to the main body for closing the bottom opening, and at least one reinforcing rib formed on the inner surface of the sole plate, the reinforcing rib being urged against the inner surface of the face portion of the main body.

DESCRIPTION OF THE PREFERRED EMBODIMENTS

Figure 1:
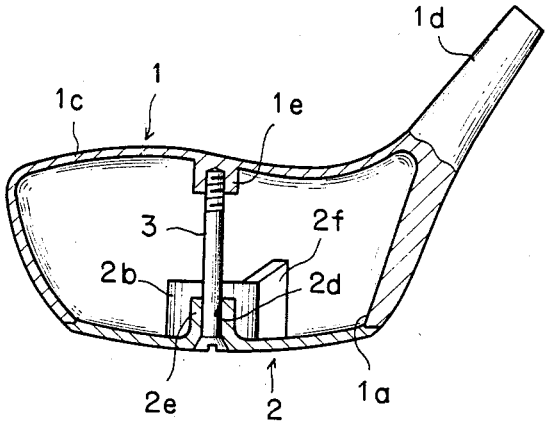
FIG. 1 is a longitudinal sectional view showing a golf club head according to this invention.
Figure 2:
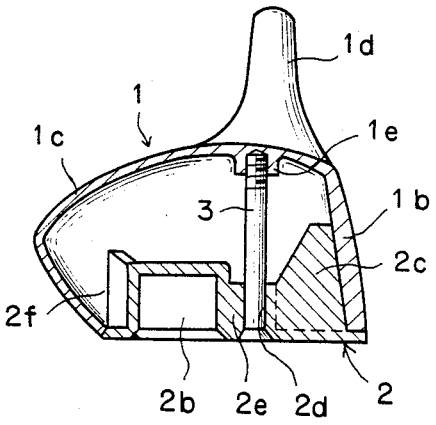
FIG. 2 is a cross-sectional view of the golf club head shown in FIG. 1.

As shown in FIGS. 1 and 2, the golf club of this invention comprises a thin wall hollow main body 1 made of metal and having a bottom opening 1*a*, and a sole plate 2 adapted to close the opening 1*a*. The main body is made to have substantially the same size and configuration as that made of wood, and it is made of such metal as steel. The main body has a thin wall construction and its face portion 1*b* has a slightly larger thickness than the outer wall portion 1*c* as shown in FIG. 2. An outwardly and upwardly inclined shaft connector 1*d* is integrally provided for one side of the outer wall portion 1*c*.

Figure 3:
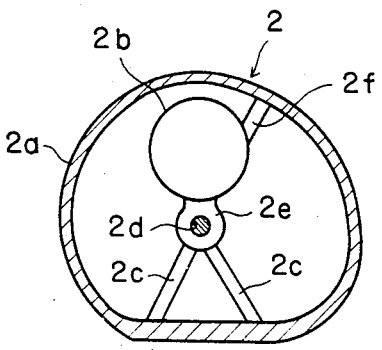
FIG. 3 is a plan view showing the plan view of the sole plate utilized in the golf club of the invention.
Figure 4:
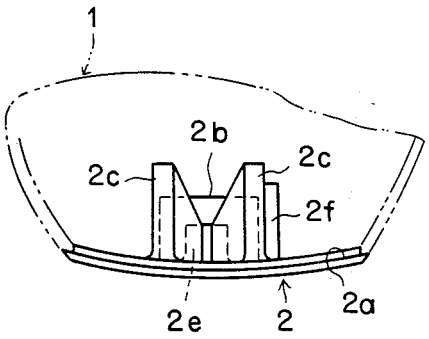
FIG. 4 is a front view of the sole plate.

As shown in FIGS. 3 and 4, the sole plate 2 is made of such metal as steel. At the periphery of the sole plate 2 is provided a fitting edge adapted to snugly fit the opening 1*a* of the main body. Furthermore, the sole plate 2 is provided with an upwardly projecting weight container 2*b* and a plurality of reinforcing ribs 2*c* adapted to closely engage the rear surface of the face portion 1*b* of the main body 1. To assemble the sole plate, the weight container 2*b* and the reinforcing ribs 2*c* are inserted into the opening 1*a* to cause the reinforcing ribs to firmly engage the inner surface of the face portion 1*b*, and then a bolt 3 is inserted into an opening 2*d* of the sole plate 2 and then threaded into a boss 1*e* on the inner surface of the outer wall portion 1*c*.

Then the engaging edge 2*a* of the sole plate 2 snugly fits with the opening 1*a*. At this time, it is advantageous to use a bonding agent to completely bond and seal the gap between the edge 2*a* and the opening 1*a*, thereby assembling the main body and the sole plate into an integral unit.

It is advantageous to form a boss 2*e* provided with the opening 2*d*, and to cause the inner ends of the reinforcing ribs 2*c* to abut against one side of the boss 2*e*. As shown in FIG. 3, two reinforcing ribs 2*c* are provided in a letter V configuration so as to receive the load applied to the face portion 1*b* by the sole plate 2 through the reinforcing ribs 2*c*. As shown in FIG. 3, the sole plate 2 is further provided with a rib 2*f* extending outwardly from the weight container 2*b* to engage the inner surface of the outer wall portion at a position opposite the face plate portion 1*b*. Then the load applied to the face portion 1*b* at the time of shooting a golf ball is received by reinforcing ribs 2*c*, the sole plate 2 and the outer wall portion 1*c* of the main body 1. In this case, the rib 2*f* is provided to extend in the direction of load created at the time of shooting a golf ball.

It should be understood that the number of the reinforcing ribs 2*c* is not limited to two but may be one, or three, or more. The reinforcing ribs may have peripheral length enough to engage the entire inner surface of the face portion 1*b* of the main body but the peripheral length of the reinforcing ribs is usually made to correspond to the ball shooting surface of the face portion 1*b*.

When the golf club head is constructed as above described, the load applied upon the face portion 1 created when it shoots a golf ball is received by the reinforcing ribs 2*c* of the sole plate 2 which support the inner surface of the face portion 1*b* so that the face portion 1*b* is imparted with such sufficiently high strength that it would not be deformed by a number of shocks created at the time of shooting a ball. Moreover, by providing reinforcing ribs 2*c* for the sole plate 2 it becomes possible to construct the main body 1 to have substantially the same size and configuration as a head made of wood. Moreover, as the main body is a hollow body of thin-wall construction, it is possible to decrease its weight and to design it to have a low center of gravity. Since the head is strong and does not deform, it is not only possible to increase the distance of flight of the ball but also to propel it in the desired direction. Moreover, since the head is made of metal, its durability or life is much longer than the head made of wood.

What is claimed is:

1. A golf club head comprising:

a thin-wall, hollow main body made of metal and having a face portion and a bottom portion, said bottom portion being provided with a bottom opening;

a sole plate made of metal and secured to said main body for closing said bottom opening in the main body and having a protrusion attached to an inner surface of said sole plate; and a pair of reinforcing ribs formed in a V-shape on the inner surface of said sole plate, said ribs being connected at the base of said V-shape to said sole plate protrusion, and at the open end of said V-shape engaging the inner surface of the face portion of said main body.

2. The golf club head according to claim 1 which comprises another reinforcing rib on an inner surface of said sole plate and extending in a direction opposite to said V-shaped ribs to engage the inner surface of said main body.

3. The golf club head according to claim 2, further comprising a hollow weight container attached to the inner surface of said sole plate and engaging said sole plate protrusion on a side opposite that engaged by the V-shaped reinforcing ribs, wherein said another reinforcing rib is engaged between said hollow weight container and the inner surface of the main body.

4. The golf club head according to claim 1 wherein said sole plate protrusion comprises a boss secured to said sole plate, and said golf club head further comprises a bolt extending through said boss and threaded to the inner surface of said main body.

5. The golf club head according to claim 1 which further comprises an inclined shaft connector at one side of said main body.

6. The golf club head according to claim 1, further comprising a hollow weight container attached to the inner surface of said sole plate and engaging said sole plate protrusion on a side opposite that engaged by the V-shaped reinforcing ribs.

* * * * *